United States Patent [19]

Artzer

[11] 4,291,732

[45] Sep. 29, 1981

[54] METHOD AND APPARATUS FOR MANUFACTURE OF WIRE TRUSS AND SINUOUS STRUT THEREFOR

[75] Inventor: Richard F. Artzer, Riverside, Calif.

[73] Assignee: Covington Brothers, Inc., Fullerton, Calif.

[21] Appl. No.: 14,988

[22] Filed: Feb. 26, 1979

[51] Int. Cl.[3] ..... B21F 1/04

[52] U.S. Cl. ..... 140/112; 140/105

[58] Field of Search ..... 140/71 R, 105, 112, 140/90; 226/14, 35, 37, 44, 107, 115, 118; 72/17, DIG. 11, 306, 307, 383, 384, 385; 29/155 R

[56] References Cited

U.S. PATENT DOCUMENTS

| | | | |
|---|---|---|---|
| 2,642,098 | 6/1953 | Stoeckel | 226/35 |
| 2,722,242 | 11/1955 | Talbot | 140/112 |
| 3,225,989 | 12/1965 | Stine | 226/44 |
| 3,612,369 | 10/1971 | Grebe et al. | 226/14 |
| 3,626,567 | 12/1971 | Michelson et al. | 29/155 R |
| 3,820,367 | 6/1974 | Kline | 72/17 |
| 4,043,494 | 8/1977 | Bickford et al. | 226/115 |

FOREIGN PATENT DOCUMENTS

| | | | |
|---|---|---|---|
| 2394339 | 2/1977 | France | 140/105 |

*Primary Examiner*—Lowell A. Larson

*Attorney, Agent, or Firm*—Gausewitz, Carr, Rothenberg & Edwards

[57] ABSTRACT

A plurality of wire trusses is employed in a three-dimensional wire matrix having a foam core to provide a light-weight structural building panel. Each truss, comprised of a sinuously bent strut wire having its apices welded to lateral runner wires, is formed by a continuous bending and wire processing apparatus which simultaneously withdraws three wires from wire supplies, sinuously bends the strut wire, assembles the bent strut wire with the runner wires, welds the joints therebetween, and severs desired lengths of completed truss sections. Several wires are fed to the bending station at different speeds and intermittently via three individually automatically controlled wire storage loops. The arrangement is such that even with the several different wire feed rates, all three wires are pulled from wire supply rolls by a single motor and all three are driven to the truss fabrication station by a single motor.

48 Claims, 17 Drawing Figures

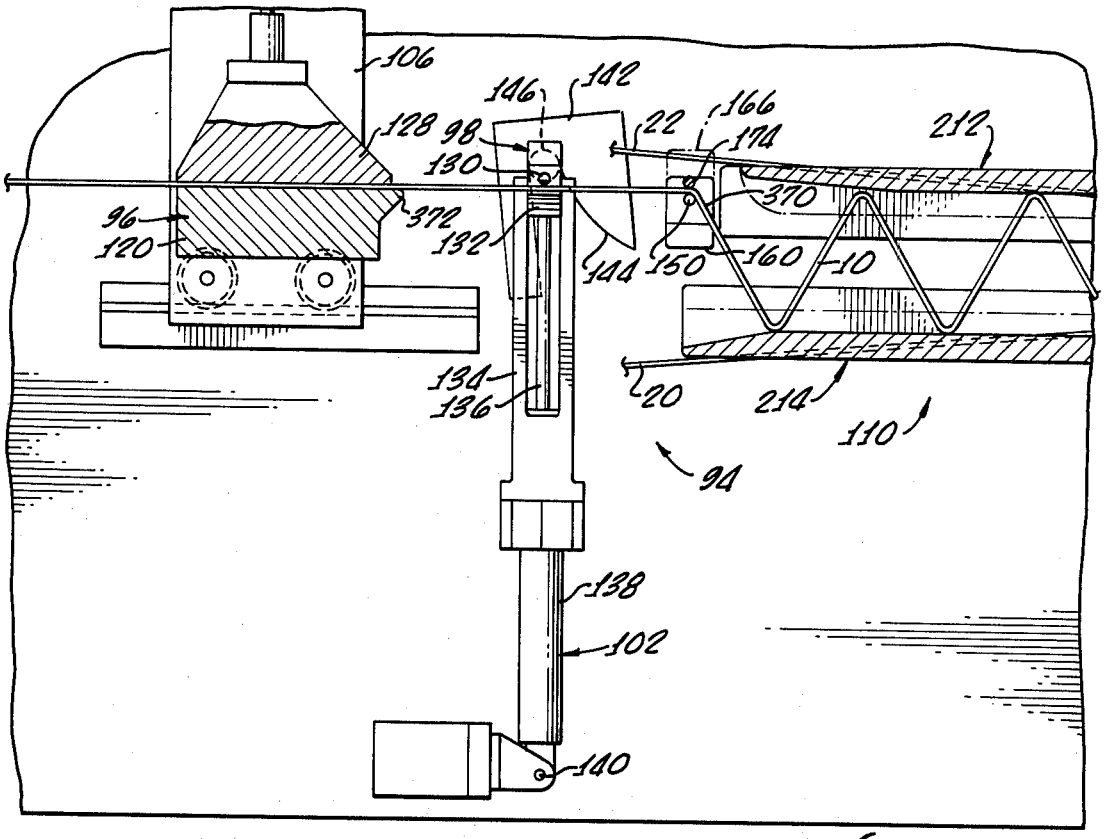
FIG. 4.
FIG. 5.
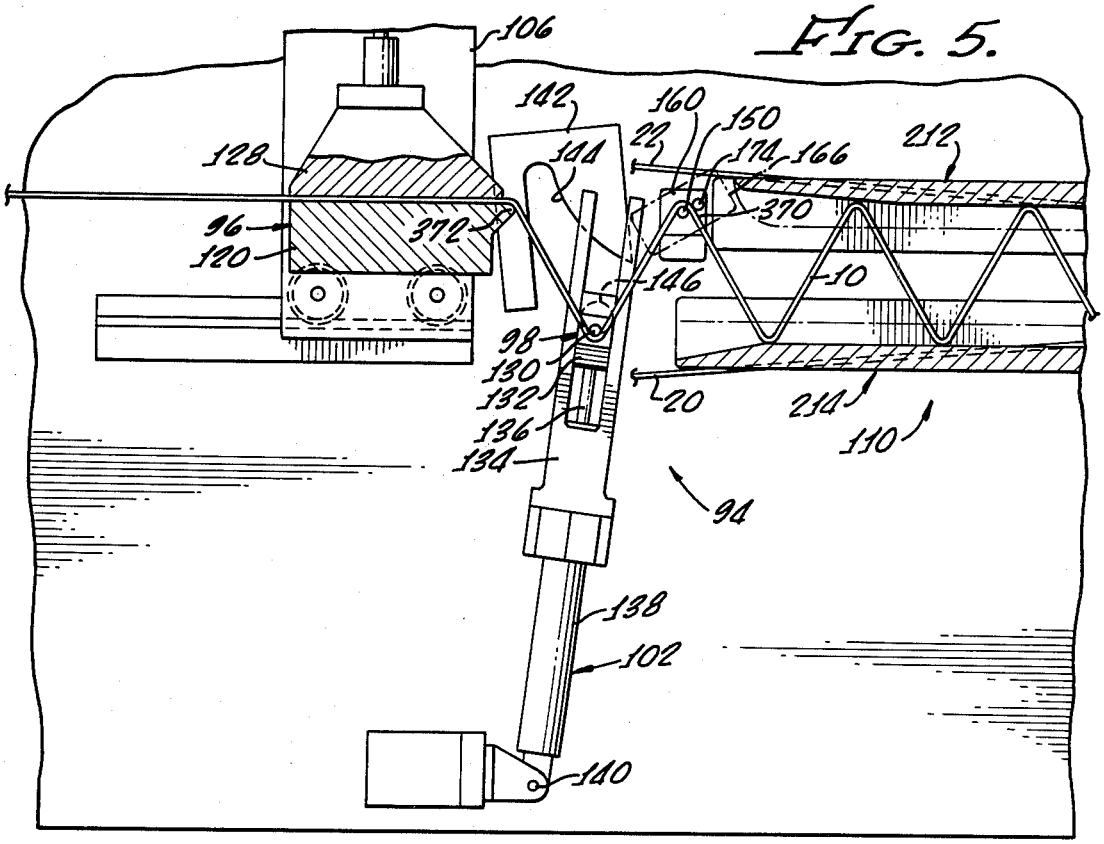

FIG. 14.
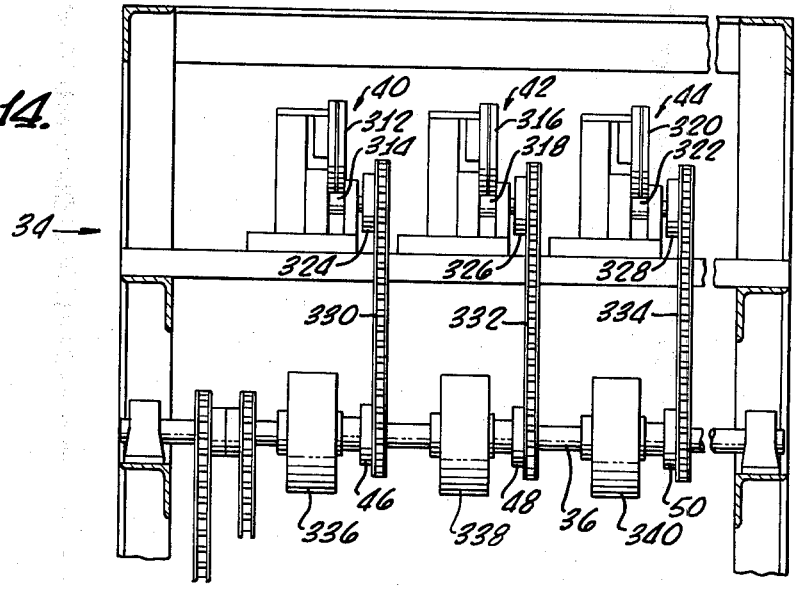
FIG. 15.
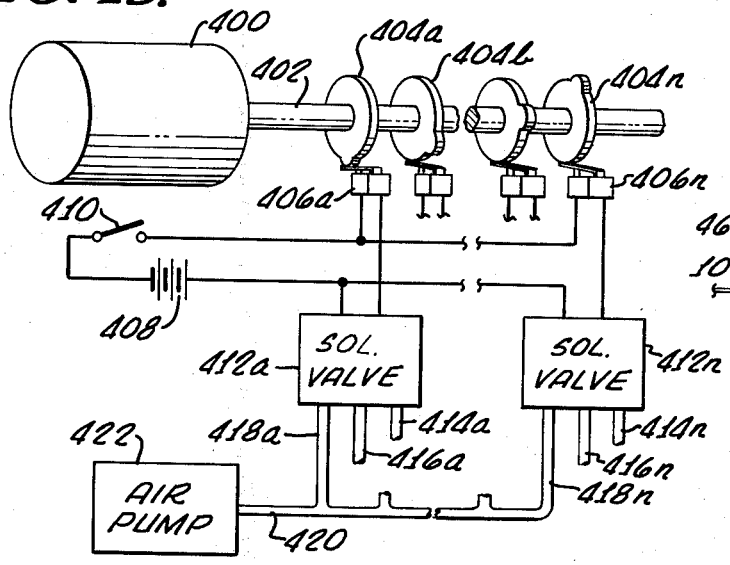
FIG. 17.
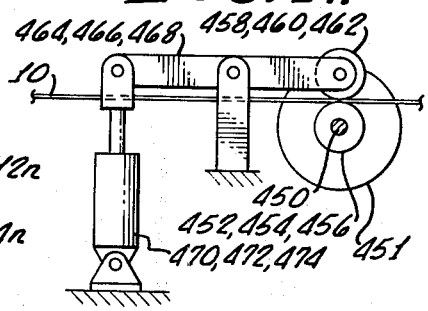
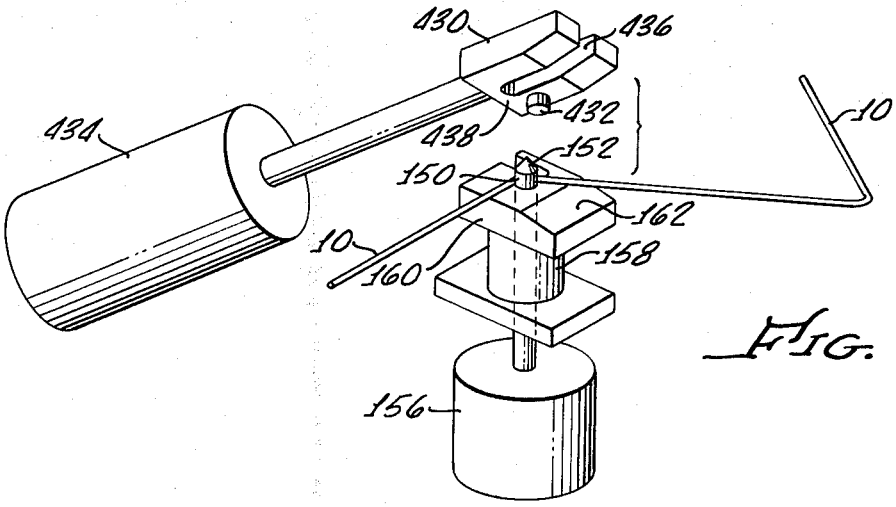
FIG. 16.

METHOD AND APPARATUS FOR MANUFACTURE OF WIRE TRUSS AND SINUOUS STRUT THEREFOR

BACKGROUND OF THE INVENTION

The present invention relates to structural panels and more particularly concerns the manufacture of wire trusses that find use as a part of a three-dimensional matrix of a structural panel having a core reinforced by such a three-dimensional wire matrix.

Various configurations employing combinations of lightweight cellular plastic foams or other filler bodies and rigid load-bearing structural elements have been suggested in the past for providing structural building panels that can effectively utilize desirable properties of cellular materials. Typical of such prior art arrangements are the U.S. Pat. Nos. 3,305,991; 3,555,131; and 3,879,908 to Weismann. Another type of composite structural panel having a hollow core and concrete outer walls is shown in the patent to Rockstead U.S. Pat. No. 4,104,842.

In my pending application for Structural Panel, Ser. No. 857,235, filed Dec. 5, 1977, there is described a composite foam and wire matrix structural panel having many improved properties, and capable of rapid, inexpensive and precision assembly and manufacture. In the panel of my copending application, a number of two-dimensional lattice structures or wire trusses and a number of elongated foam filler elements are interdigitated, in consecutive alternation, and then laterally pressed against one another to forcibly embed the trusses in the filler elements. While holding such interdigitated structures and elements in laterally pressed condition, the trusses are fixedly secured to one another by means of a number of mutually spaced, transversely extending cross-members which are welded to the runner wires of the respective trusses. Advantages of this panel and its method of construction are set forth in detail in the copending application.

The present invention is concerned with methods and apparatus for manufacture of flat lattice structures, substantially two-dimensional trusses, that are employed in the manufacture of such composite structural panels. Although the methods and apparatus described herein are uniquely adapted for the manufacture of trusses and analogous structural elements, the machine and methods described herein may be readily employed for manufacture of a continuous sinously bent wire for other applications.

SUMMARY OF THE INVENTION

In carrying out principles of the present invention in accordance with a preferred embodiment thereof, a wire is clamped at a rearward area spaced from a previously bent forward area thereof, blocking dies are moved into engagement with the previously bent area so as to resist forward and transverse motion of the wire at the previously bent area, and an intermediate area of the wire between the forward and rear areas is transversely displaced as the rear and forward areas are moved toward each other so as to bend the wire at each of the areas. The blocking dies are withdrawn, the wire advance, the first steps are repeated, clamping a rearward area, again moving the blocking dies into engagement with the previously bent portion and transversely displacing an area therebetween while moving the blocking dies and clamped areas toward each other.

This bends the wire at the intermeidate area, at the second rearward area, and completes the bend at the area grasped by the blocking dies. According to a particular feature of the invention, the blocking dies comprise an inner blocking die in the form of a retractable pin and an outer blocking die in the form of a die that rotates about the retractable pin so as to engage the previously bent wire area.

The sinuously bent strut wire is then passed through a guide which also guides a pair of lateral wires into contact with the strut wire at apices thereof so that the wires may then be clamped together and welded.

According to another feature of the invention, each of the wires is fed to the bending apparatus via an individual wire storage loop into which wire is fed at a rate determined by the amount of wire in the individual loop. The feeding of wire into each individual storage loop causes a wire-pulling drum to withdraw wire from a large supply roll so that wire is withdrawn from the roll in accordance with the feeding of wire into the storage loop.

BRIEF DESCRIPTION OF THE DRAWINGS

FIG. 4 illustrates further details of bending and guiding portions of the apparatus of FIG. 3 in position to make a set of bends.

FIG. 5 shows the apparatus of FIG. 4 upon completion of the making of the set of bends.

FIG. 14 is a section taken on lines 14—14 of FIG. 13.

FIG. 15 is a diagram of a control system for the various apparatus motors.

FIG. 16 shows a modified form of blocking dies.

FIG. 17 illustrates an alternate apparatus for feeding wire to the bending and truss assembly stations.

GENERAL DESCRIPTION

A wire truss manufactured by the apparatus and methods described herein comprises a continuous sinuously bent strut wire 10 having opposed and oppositely disposed apices 12, 14, 16, 18, etc., to which are welded lateral runner wires 20, 22 that extend longitudinally for the full length of the truss. Each lateral wire overlies the strut wire, contacting all apices at the respective side of the truss and strut wire. The runner wires may be laterally positioned flush with the outermost surfaces of strut wire apices or slightly inwardly thereof. For greater truss strength, the latter is preferred.

Such a truss, formed of a very hard, high strength wire of about 0.080 inches in diameter, No. 14 gauge wire for example, is a widely useful structural member having light-weight and great structural strength and rigidity in two dimensions. It may be used in a variety of applications where such properties are desired. A presently preferred application is the use in a composite structural panel wherein a plurality of sections of such trusses are stacked alternately with a number of elongated sections of plastic foam filler elements. The stack is compressed to embed the trusses in the foam filler elements, and the several trusses are then connected together by having runner wires 20, 22 welded to a number of cross-wires running across the assembly from truss to truss. Such a panel and trusses used therein are described in my copending application identified above. The truss of FIG. 1 may also be employed in composite structural panels of the type described in the several patents identified above.

GENERAL ARRANGEMENT

Figure 2:
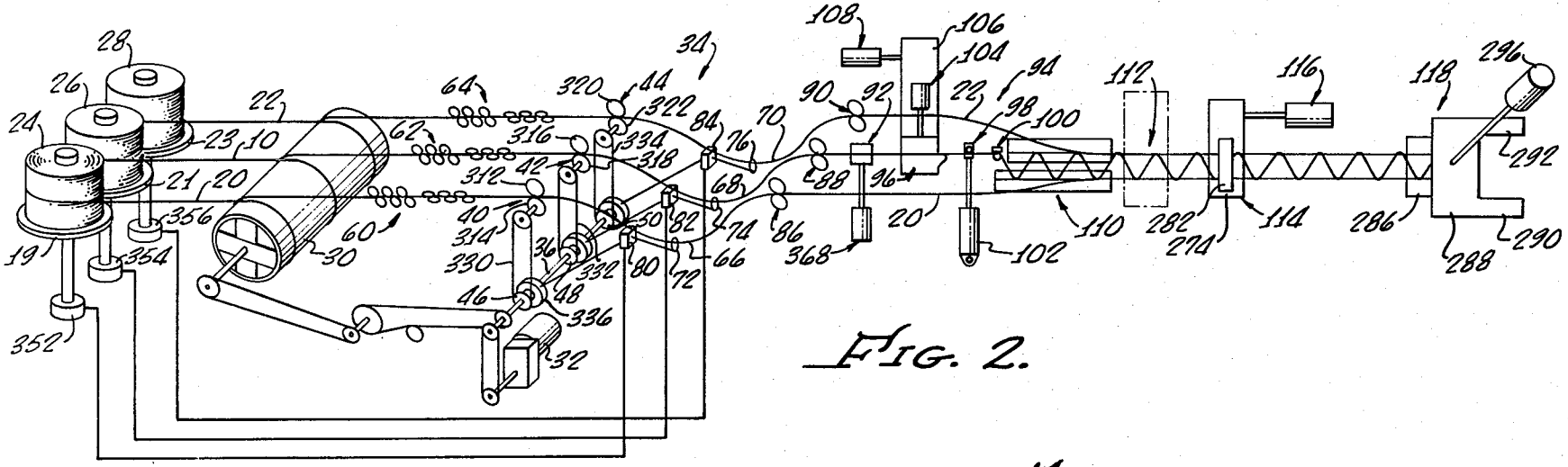
FIG. 2 is a schematic diagram of an apparatus for making a truss of FIG. 1.

As shown in the schematic flow diagram of FIG. 2, three wires, from wire supply rolls 24, 26, 28, are fed over a wire pulling drum 30 driven, via a series of belts and pulleys, by a motor 32 and thence, via a straightening mechanism, fed to a wire feed mechanism 34 having a common drive shaft 36 driven by the motor 32. Feed mechanism 34 includes three selectively operable feed roller pairs 40, 42, 44 which are individually driven by respective clutch controlled drive sprockets 46, 48 and 50, respectively.

Wire is pulled by the roller pairs 40, 42, 44 through sets of straightening rollers 60, 62, 64, interposed between the feed rollers and the pulling drum. From the feed rollers, each wire passes through an individual one of three variable length, variable curvature paths or wire storage loops 66, 68, 70. Position of wire in the loops is individually sensed by respective ones of a group of sensor rings 72, 74, 76 which provide a feedback control of the clutch controlled drive pulleys 46, 48, 50 via feedback controllers in the form of switches 80, 82, 84.

Wire from the three storage loops is fed via guides 86, 88, 90, central wire 10 going through a brake 92, to a bending station generally indicated at 94. The bending station includes a rear clamp 96, an intermediate or transverse displacement die 98 and a pair of blocking dies 100. Transverse displacement die 98 is moved laterally by a motor 102 while the clamp 96, which is actuated by a clamp motor 104 and mounted on a longitudinally movable slide 106, is driven to and from the blocking dies 100 by a motor 108.

The bent strut wire 10 is then assembled with the lateral wires 20, 22 in a wire guide and assembler station 110 from which it is fed to a welding station 112 where the lateral wires 20, 22 are welded to the bent strut wire adjacent the apices thereof.

A truss puller, in the form of a clamp 114 longitudinally driven by a motor 116, clamps a completed portion of the truss and, after a pair of welds has been made, advances the entire completed truss section, together with the still unattached lateral and strut wires to position these for the next bend. The completed truss is advanced through a cutting station 118 which cuts the continuous length of completed truss into desired lengths.

APPARATUS

Figures 1, 3:
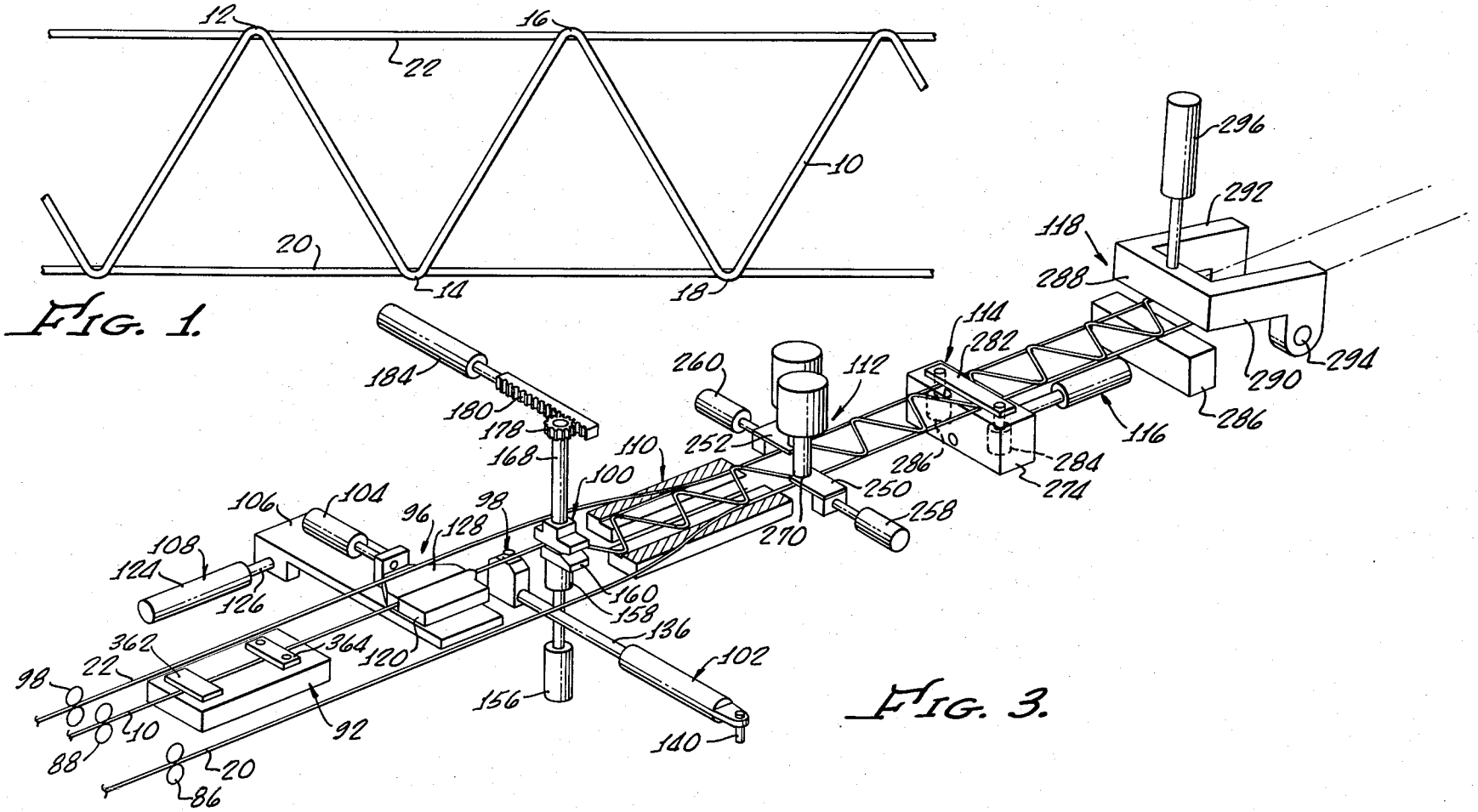
FIG. 1 illustates a length of a wire truss made by the method and apparatus disclosed herein.
FIG. 3 is a simplified structural diagram of major components of truss-making apparatus of the present invention.

Referring now to FIG. 3, rear clamp 96 comprises a first clamp part 120 fixed to the clamp slide 106 that is mounted to the machine bed for bi-directional longitudinal motion under control of air motor 108. Air motor 108 comprises an air cylinder 124 driving a piston rod 126 which is fixed to the slide 106, the motor cylinder 124 being fixedly mounted to the machine bed. A second clamp part 128 is mounted on slide 106 for suitable motion transverse to the longitudinal extent of the machine bed and processing station under control of air motor 104. Thus, the strut wire 10 can be releasably clamped in the rear clamp and moved forwardly under control of motor 108.

Transverse displacement die 98 is formed of an upwardly projecting pin 130 (FIG. 6) fixedly carried on a slide block 132 which in turn is movably mounted to slide along the length of an elongated transversely disposed slotted and bifurcated guide 134. Guide 134 is fixedly carried at the end of an air motor piston rod 136, mounted in a cylinder 138 pivoted to the machine bed about the vertical axis of a pin 140 at a point displaced from the longitudinal path of travel of the truss wires.

A cam plate 142 is fixed to the machine bed and carries a cam surface 144 disposed generally across the longitudinal path of travel of the strut wire 10 for cooperation with a cam follower 146 carried by the slide block 132 below the plane of the truss wires.

The blocking dies include outer and inner elements. The inner blocking die comprises a pin 150 having a conical upper surface 152 fixed to an end of a vertically reciprocable piston rod of an air motor cylinder 156 carried by the machine bed. The piston rod and pin 150 are reciprocable through a guide sleeve 158. Fixed to the upper end of sleeve 158 is a guide plate 160 having a laterally downwardly inclined surface 162. Sleeve 158 is fixed to a plate 164 which in turn is fixedly mounted to the machine bed.

Figure 12:
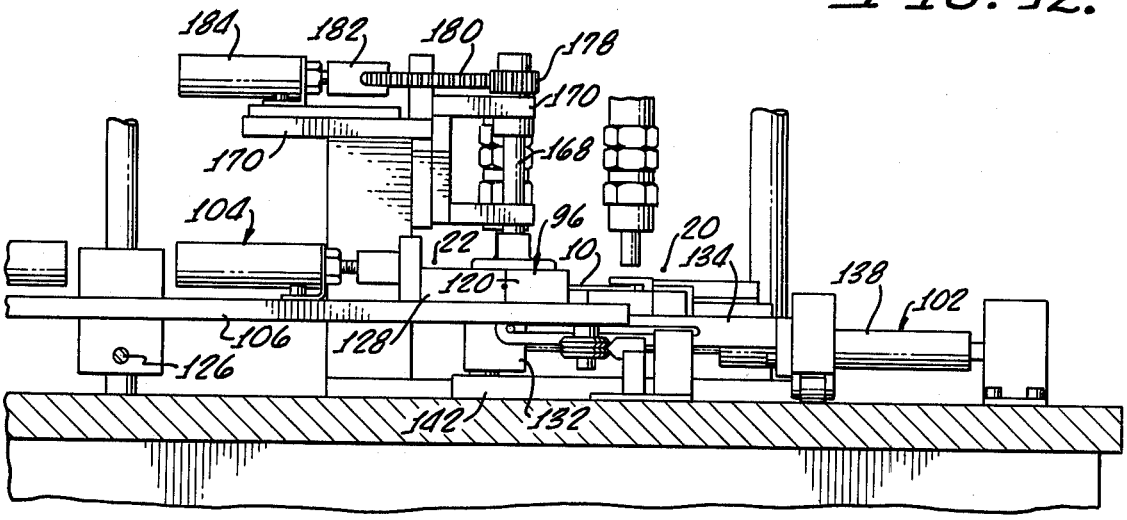
FIGS. 11 and 12 are sections taken on lines 11—11 and 12—12 of FIG. 10.

A shiftable outer blocking die 166 is fixed to a rotary die shaft 168 journalled in a structure 170 (FIG. 12) fixed to and above the machine bed and coaxial with pin 150. Die 166 has a generally horizontally extending guide surface 172 that is in close face-to-face juxtaposition with but spaced from the upwardly facing surface of guide 160 to permit the strut wire 10 to be passed therebetween. The outer blocking die also includes a downwardly extending blocking projection in the form of a dowel 174, having a vertically extending cylindrical surface that contacts the outer surface of a diagonally extending portion of the previously bent wire. It also includes a hole 175 receiving pin 150. Thus, the blocking dies grasp the wire at the apex of the previously formed partial bend.

Shaft 168 fixedly carries a pinion 178 which meshes with a rack 180, mounted for slidable motion along support 170 by connection to a rack drive block 182 fixed to a piston rod of an air motor cylinder 184 that is mounted for manual adjustment transverse to the longitudinal extent of the machine bed.

Outer blocking die 166 has its guide surface 172 formed with an outwardly and upwardly inclined surface 173 that cooperates with outwardly and downwardly inclined surface 162 to facilitate initial placement of a wire to be bent.

Figures 7, 8, 9:
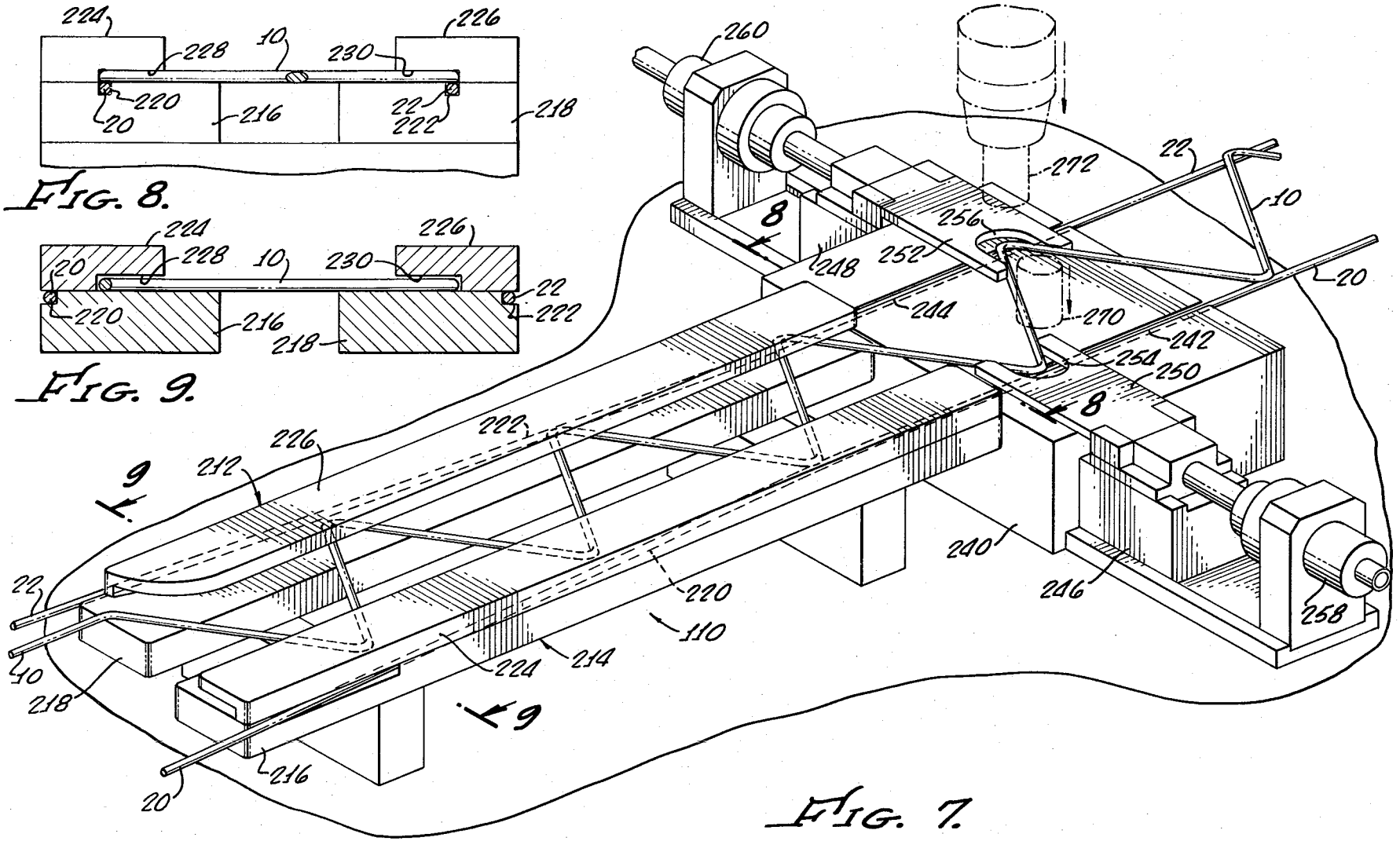
FIG. 7 is a perspective view of the guiding and welding portions of the apparatus.
FIGS. 8 and 9 are sections taken on lines 8—8 and 9—9 of FIG. 7.

Further along the machine bed, to the right as viewed in FIGS. 3 and 7, is positioned the wire guide and assembler block 110. The wire guide and assembler 110 is formed of two laterally spaced nearly identical, but mirror image, sections 212, 214. Each section comprises a longitudinally extending flat plate 216, 218 fixed to the machine bed and having formed in upper surfaces thereof longitudinally extending grooves 220, 222. The grooves extend from the outer sides near rearward ends of the plates, being inclined inwardly towards the forward ends of the plates, and extending completely to the forward ends thereof. Thus, the lateral wires may enter the grooves at the sides of the plates 216, 218 and be guided therethrough inwardly to a lateral spacing substantially equal to the width of the sinuously bent strut wire. Fixedly connected to the top surface of each guide plate 216, 218 is a somewhat "L"-shaped upper guide bar 224, 226 having horizontally extending portions spaced above the upper surfaces of the guide plates 216, 218 to form strut wire guide channels 228, 230. The guide channels are positioned immediately above the lateral wire guide grooves since the latter are formed in the upwardly facing surfaces of the plates 216, 218 which form the lower sides of the guide channels.

Fixed to the machine bed immediately adjacent the forward end of the assembler 110 is a weld guide block 240, having channels 242, 244 formed in its upper surface for receiving and guiding the lateral wires as they emerge from the guide grooves 220, 222.

Fixed to the machine bed on opposite sides of the guide block 240 are weld finger support blocks 246, 248 on which are slidably mounted oppositely disposed weld holding fingers 250, 252 having inwardly facing and inwardly opening recesses 254, 256. The weld fingers are mounted for transverse sliding motion toward and away from the strut wire just above the upper surface of guide block 240 so as to lie in the plane of the bent strut wire 10.

At this station of the process, the strut wire lies in a plane just above the plane of the lateral runner wires and has the lower side of the apices thereof in contact with or close to the uppermost portion of the lateral wires. The weld holding fingers 250, 252 are driven transversely inwardly to engage the bent strut wire at and on both sides of each of a pair of oppositely disposed apices thereof by means of single-acting spring-return air motors 258, 260 fixedly mounted to the machine bed.

An overhead bridge structure 262 (FIGS. 10 and 11) extends transversely across the machine bed, is mounted for vertical reciprocal motion upon a number of vertically extending guide rods 264, and is driven up and down by a double-acting air cylinder 268. The bridge structure carries a pair of welding electrodes 270, 272, which are positioned immediately above the respective recesses 254, 256 and the weld holding fingers, whereby the electrodes can be lowered to press against the strut wire apices while the latter are grasped within the holding finger recesses.

Slidably mounted on the machine bed forwardly of the welding station is a truss advancing block 274, connected to be driven in either direction longitudinally of the machine bed by double-acting air motor 116. A truss clamp bar 282 is vertically reciprocated toward and away from the upper surface of the truss advance block 274 by means of a pair of single-acting spring-return air cylinders 284, 286 which have their piston rods extending through the advance block 274 for connection to opposite ends of the truss clamp bar 282.

Forwardly of the longitudinally reciprocating truss advance station is the cut-off station 118 comprising a shear block 286 fixed to the machine bed and extending across and below the completed truss. A truss cutting yoke 288 extends across and above the truss just forward of the forward edge of the shear block 286 and has a pair of forwardly extending arms 290, 292 fixed thereto and pivoted to the machine bed about a horizontal transverse axis 294. The truss cutter yoke 288 is driven downwardly or upwardly to cut the truss and retract the cutter by a double-acting air cylinder 296.

Figure 13:
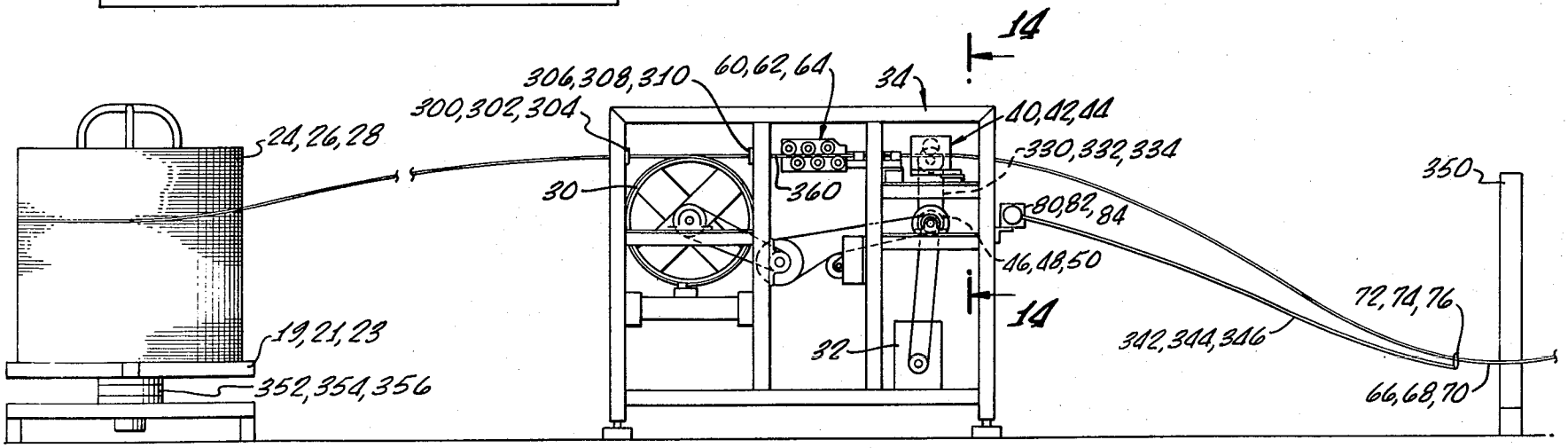
FIG. 13 is an elevation view of the apparatus for feeding wire to the bending and truss assembly stations.

As can be seen in FIGS. 2 and 13, the several wires are fed individually and in identical fashion from the wire supply rolls 24, 26, 28 mounted on rotatable lazy susan structures 19, 21, 23 and thence fed through wire guides 300, 302, 304, in a single loop around the rotating drum 30 to drum output guides 306, 308, 310. From the drum output guides, the wire is fed through the straightening rollers 60, 62, 64 and thence the three are passed respectively between individual pairs of wire feed roller pairs 40, 42, 44 formed of rollers 312, 314, 316, 318, 320, 322 (FIG. 14). Rollers 312, 316, and 320 are idler rollers. Rollers 314, 318, and 322 are the wire drive rollers, each being driven by respective ones of sprocket wheels 324, 326, 328, chains 330, 332, 334, and clutch controlled drive sprockets 46, 48, 50. Drive sprockets 46, 48, 50 are individually and selectively coupled to the common drive shaft 36, continuously driven by motor 32, by means of respective ones of three electromagnetic clutches 336, 338, 340.

The clutches are individually energized by means of the individual switches 80, 82, 84 which themselve are operated by sensor rods 342, 344, 346 which respectively carry at their outermost ends the sensor rings 72, 74, 76 through which pass the strut wire 10 and lateral runner wires 20, 22, respectively.

Figure 10:
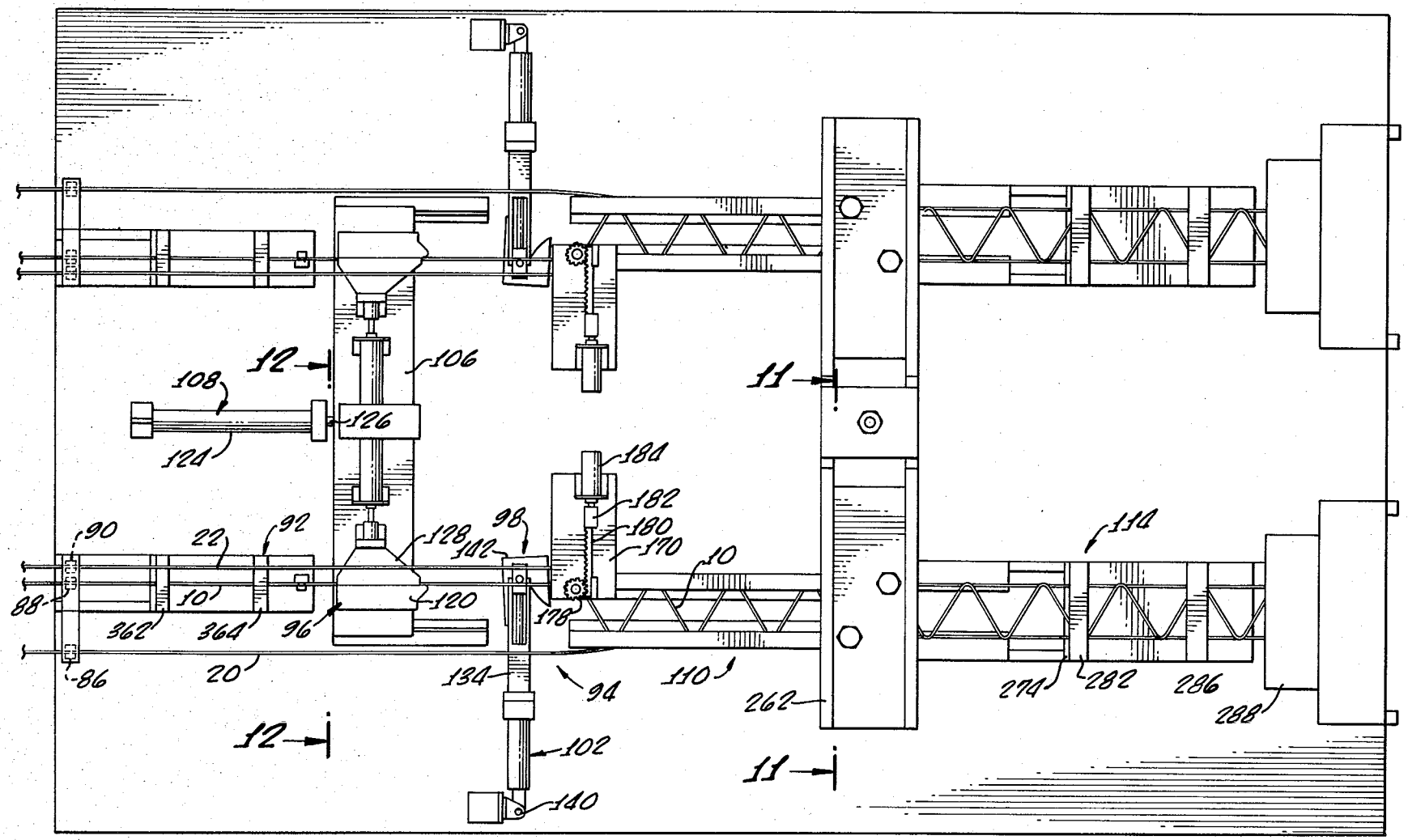
FIG. 10 is a plan view of the portions of a preferred mechanization of the apparatus.
Figure 11:
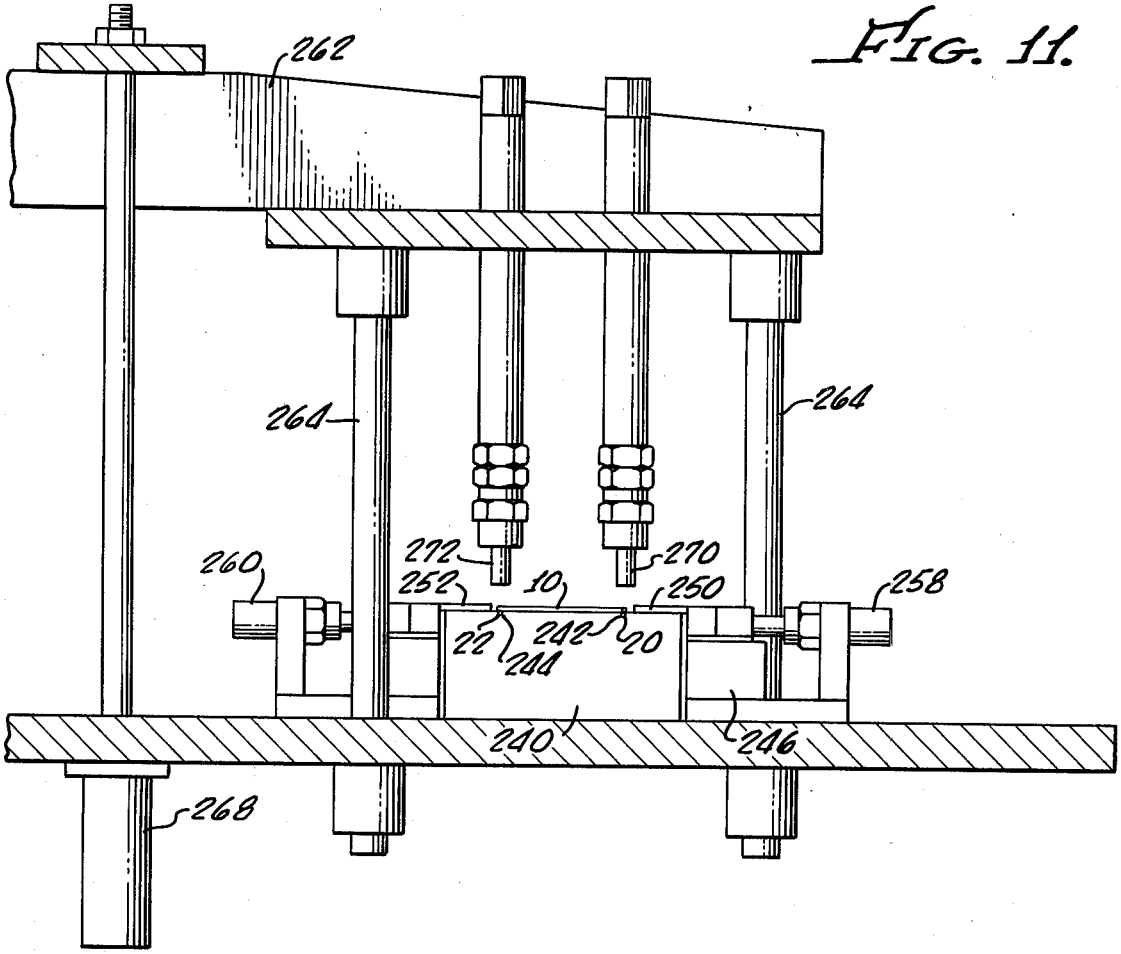

From the wire feed roller pairs 40, 42, 44, the several wires extend downwardly in a slack loop through paths of variable length and variable curvature, guided in vertically extending slots of a storage loop guide 350 from whence the wires are fed to the guide rollers 86, 88, 90 (FIG. 10).

Electric switches 80, 82, 84 are connected to operate both the clutches 336, 338, 340 of the respective wire feeds and brakes 352, 354, 356, respectively, that are arranged to alternatively stop or permit rotation of the respective wire supply roll rotary supports 19, 21, 23.

WIRE FEED OPERATION

The withdrawal of each wire from its supply roll and the feeding thereof to the various bending, assembly and welding stations is substantially identical, and thus, a description of the feeding of one wire will suffice to describe the feeding of all.

Wire 20 is pulled from the supply roll 24 by means of the drum 30. When tension is applied to a wire portion 360 between the drum and the straightener rollers 60, the wire loop around the drum is tightened, frictionally engaging this loop with the drum and causing the continuously rotating drum to pull the wire from the supply roll. Tension is applied to the wire section 360 whenever the wire 20 is driven between the rollers 312, 314. The wire is driven by and between these rollers when clutch 336 is energized to lock the sprocket 46 to the continuously rotating shaft 36.

If there is an ample supply of wire in storage loop 66, the wire in the central section of this loop falls to a lower portion of the guide 350. Sensor 72 actuates switch 80, placing the switch in a first position in which the clutch 336 is de-energized and in which brake 352 is energized. Thus drive rollers 312, 314 are not driven, the rotary support of supply roll 24 is locked against rotation, and no wire is withdrawn from the roll or fed to the storage loop 66.

As the wire is processed through the bending, assembly and welding stations, wire is drawn from the storage loop 66, the length and curvature of this loop changes, and the central section of the loop rises. This lifts the sensor 72 to operate switch 80 to its second position in which the clutch 336 is energized and the brake 352 is released. Now roller 314 is driven by the belt and pulleys and, together with roller 312, pulls the wire 20 through the wire straighteners 60 into the storage loop 66. As the wire 20 is driven by rollers 312, 314, section 360 of this wire is tensioned to tighten the wire around the drum thereby causing the drum to pull this wire from storage roll 24.

Each of the wires 10 and 22 is individually and independently pulled from its supply roll and driven into its individual, variable-length, variable curvature storage loop in a similar manner. Although each wire is independently driven, only one motor is required to drive the common wire-pulling drum. The arrangement automatically insures that a predetermined amount of wire is stored in the loops 66, 68, 70 for use in the truss assembly operation, even though the feed rate of the several wires is significantly different. Since only the central strut wire 10 is bent, this wire is used at a greater rate and must be fed at a greater rate. However, the described arrangement automatically controls the rate of feed in accordance with the rate of use by drawing wire from a storage loop as needed. The storage loop automatically retains an amount of wire between preselected maximum and minimum amounts.

In a preferred form of the apparatus, two identical trusses are simultaneously formed in side-by-side processing channels of a single machine as can be seen in FIG. 10. The two processing channels are each identical but of opposite hand and are, in fact, substantially independent processing operations except for the sharing of a common clamp slide 106, a common clamp slide drive motor 108 and a transverse welding bridge structure 262, that extends across both channels and simultaneously drives both pairs of welding electrodes upwardly and downwardly. Thus, the description of one channel will suffice to explain operation of both. Of course, all of the described components may be mounted on a single machine bed that supports the two side-by-side channels. Similarly, the wire feed for two channel processing employs common support elements, a common feed drum for all six wires, and a common drive for the six separately controlled feed rollers and clutch drives.

TRUSS ASSEMBLY OPERATION

The strut wire and the two lateral wires are fed from the supply rolls via the feeding arrangement illustrated in FIG. 13 to the forming, assembly and welding stations, and more specifically, to and through the wire input guides 86, 88, 90 thereof (FIGS. 2, 10). Guide 88 is positioned closer to the guide 90 then to the guide 86 because the strut wire which is passed through guide 88 will be bent and in such bending will be displaced transversely toward the lateral wire 20 which is positioned by the guide 86. The two lateral wires extend from guides 86, 90, and through positioning apertures in supports 87, 89, without further processing, directly into the respective grooves 220, 222 (FIGS. 6 and 7).

The strut wire 10 passes from the guide 88, loosely under a hold down bar 362, under a bar 364 of rear brake 392, and thence to and between the parts of rear clamp 96. Rear brake bar 364 is vertically reciprocal under control of a double-acting air motor 368 (FIG. 2) so as to selectively lock the strut wire 10 to the machine bed.

Figure 6:
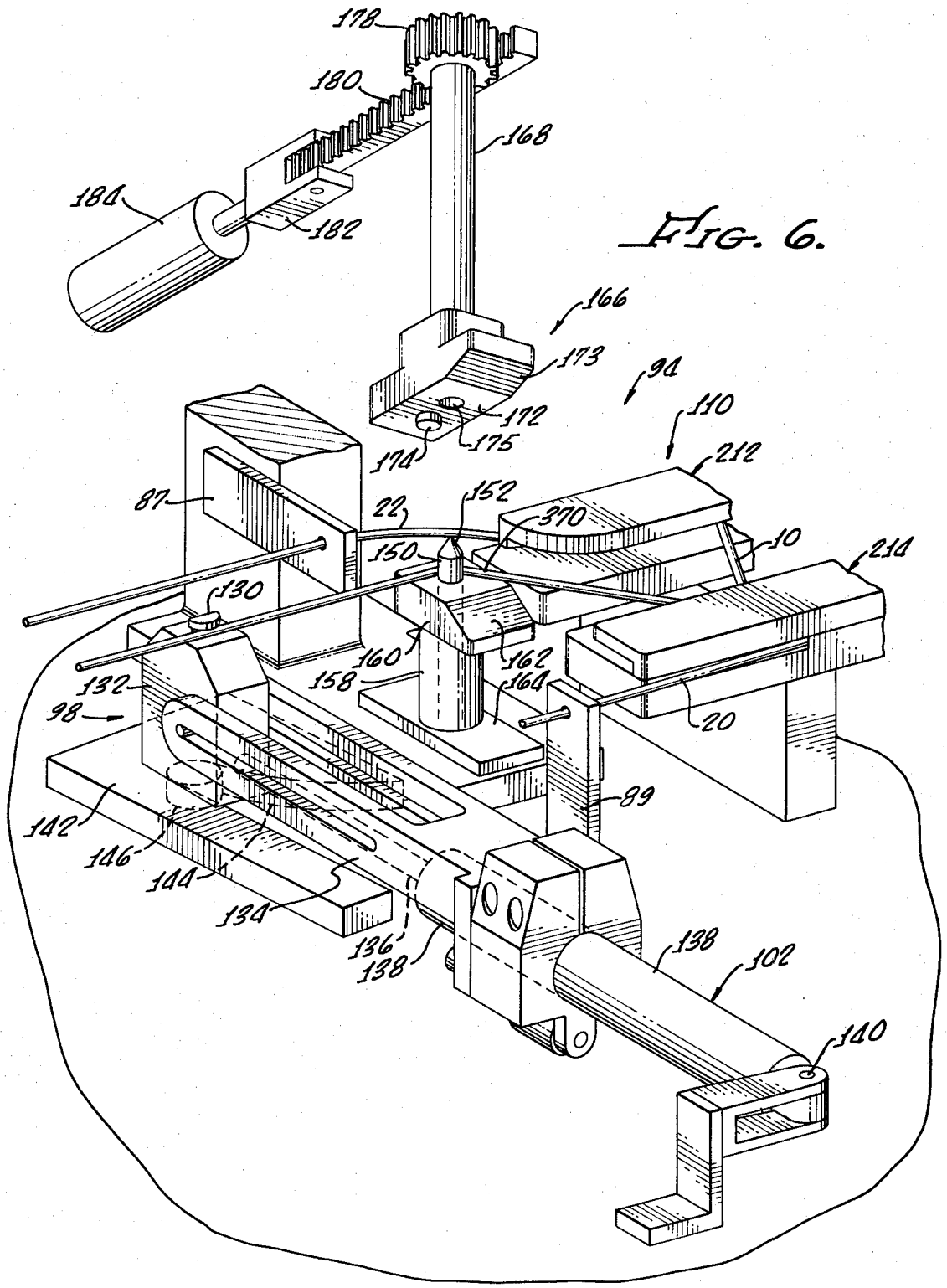
FIG. 6 is a simplified perspective view of the blocking dies of the apparatus.

The strut wire passes from the clamp 96 along one side of the transverse displacement die pin 130 and thence between the surfaces of blocking guides 160, 172 (FIG. 6).

Prior to making a bend, the dies are positioned as illustrated in FIG. 4. Rear brake bar 364 is released, clamp 96 is in a rearward, retracted position (to the left as viewed in FIG. 4). Transverse displacement die 130 is extended inwardly and its carrying slide 134 is positioned substantially perpendicular to the length of the wire. Inner blocking die 150 is retracted below the surface of guide 160 and rack 180 is in a retracted position so that the outer blocking die 174 contacts the strut wire, being transversely aligned with inner die 150 and transversely displaced from the outer side of the yet unbent portion of the strut wire 10.

To create a bend, inner block die 150 is driven upwardly by motor 156, its cam surface 152, insuring that this die is positioned on the proper side of the strut wire. The rack 180 is advanced outwardly by motor 184 to rotate the outer blocking die 166 about the axis of die pin 150 in a clockwise direction as viewed in FIG. 4 so as to engage a diagonally extending portion 370 of the strut wire and to extend across the longitudinal path of motion of the strut wire held in the clamp 26. If an initial bend is being formed, that is, at the start of an operation, it is an end portion of the strut wire that initially extends between the inner and outer blocking dies. Thus, the rotary motion of the outer blocking die will initially bend this free end portion and enable these dies to position and hold a forward area of the strut wire as the bend is being made. The described rotary motion of the outer blocking die facilitates the grasping of the forward area of the trust wire even though this portion of the strut wire may be somewhat displaced from its desired position. Even though the previously bent diagonal strut wire portion 370 is not positioned precisely at or along a tangent to the inner blocking die 150, the rotary motion of outer blocking die 174 will enable the latter to capture the previously bent diagonal portion 370 and properly position it for the blocking action.

If previously bent wire portion 370 is not at the desired angle, due to variation in wire characteristics such as springback, or for other reasons, the rotation of outer blocking die 174 to the position of FIG. 5 helps to establish the desired relation. The effect of die 174 can be varied by manually moving and adjusting the transverse position of motor 184, in effect varying the length of the stroke of this motor.

After the blocking dies have been respectively driven upwardly and rotated, the air motor 102 is actuated to pull displacement die 130 outwardly (downwardly as viewed in FIG. 4) against the strut wire. Simultaneously, rear clamp 96, which firmly grasps the strut wire, moves forwardly toward the blocking dies. As the displacement die 130 is pulled outwardly and the rear clamp 96 moves forwardly, the strut wire bends about the inner blocking die 150. Die 130, together with its slide 134 and motor 102, pivot clockwise (as viewed in FIG. 4) about pin 140 toward the position illustrated in FIG. 5. The strut wire also bends around a rounded, forwardly projecting lip 372 that forms a die portion of the clamp 96. In the same operation, the strut wire is fully bent at its area of contact with displacement die 130 and further bent about the inner blocking die 150 to complete the bend at this area.

It is essential that the truss width, the distance between lateral wires 20, 22 and the distance between opposite apices of the strut wire, be uniform and precise for use in many applications, and particularly, in the above described structural panel. Thus, it is highly important that the transverse die 130 be precisely positioned mid-way between the rear clamp 96 and the blocking dies 100. If the bend made by the die 130 produces unequal lengths of diagonal wire from such bend to the adjacent apices on the opposite side of the truss, the truss width may vary unacceptably. Further, because the wire employed for the truss is a hard, relatively stiff wire, the point of initial contact between the die 130 and the wire 10 must remain the same in moving from the position of FIG. 4 to the position of FIG. 5. The die cannot move along the wire during transverse motion of the die. Thus, the die is mounted to pivot about axis 140 as it bends the wire and, moreover, is precisely returned to its initial position (FIG. 4) by the operation of cam surface 144 and cam follower 146.

WELDING

Welding takes place during the above described bending operation. Those portions of the several wires between the blocking dies and the welding station are not involved in the bending operation and undergo no motion during this time. These wires have been properly assembled for the welding and, thus, the lateral runner wires may be welded to the strut wire during the bending. The weld clamp fingers 250, 252, initially retracted, are driven inwardly in syncronism with one another by air motors 258, 260. The recesses 254, 256 of the weld fingers abut diagonally extending portions of the bent strut wire on opposite sides of the apices which are received in the weld finger recesses. This mutually opposed pressure of the two weld fingers firmly clamps the bent strut wire and laterally positions it with respect to the lateral wires 20, 22. The latter, being guided in the grooves 242, 244 of the weld guide block 240, are firmly held directly beneath the strut wire apices. Preferably, the lateral wires are positioned by the described apparatus so that each lateral wire will contact a diagonally extending portion of the strut wire on either side of and immediately adjacent the strut wire apex. This insures a greater area of contact between the lateral wires and the strut wire.

The plane of the strut wire, which is held in the closely adjacent wire guide and assembler 110, is close to the upper surface of the weld guide block 140 which holds the lateral wires 20 and 22 at such upper surface. Accordingly, the bent strut wire is closely adjacent to and above the lateral wires.

With the strut wire and lateral wires clamped in position as described, weld drive motor 268 is actuated to drive the weld electrodes downwardly so as to press against the strut wire apices within the holding finger recesses 254, 256. Welding current is then passed through the machine bed, through the wires at one apex, through one electrode, thence via a connecting wire (not shown) to the other electrode, through the wires at the other apex being welded, and back to the power supply through a second portion of the machine bed, the latter being insulated from the bed portion carrying current to the other electrode.

On completion of the weld operation and completion of the bending, the welding electrodes are raised and the weld clamp fingers are retracted. At the same time, various bending dies are also retracted, moving back to the position of FIG. 4. For this retraction, rear brake bar 364 is actuated to clamp the strut wire. Transverse displacement die 130 is driven back toward the center line of the unbent strut wire. As the die 130 is so driven, the cam follower pin 146 depending from the die block 132 engages the surface 144 of cam 142. This cams the support and drive assembly of the transverse die 130, causing it to rotate in a counter-clockwise direction back to the position of FIG. 4.

As the die 130 is retracted, the blocking dies are also retracted, pin 150 being moved downwardly below the upper surface of guide plate 160 and rotary outer blocking die 174 being rotated in a counter-clockwise direction by the retraction of rack 180.

As the blocking dies and transverse displacement dies are retracted, clamp 96 releases the strut wire and motor 108 retracts the clamp 96, moving it along the strut wire, which is held against further motion by the rear brake bar 364. Now the various dies and rear clamp are back to the initial position shown in FIG. 4 and ready for advance of the completed truss and advance of all wires for the start of another bend. While the clamp 96 is moving to its initial pre-bend position (as shown in FIG. 4), truss puller 274 is returning to its rearward position, moving toward the weld station, so as to be ready to advance the work after the next bending and welding operation.

Having retracted the dies 130, 150 and 174, all of the wires and completed truss sections may be advanced. Thus, the motors 284, 286 are energized to cause clamp bar 282 of the truss puller to clamp a completed sectionof the truss. Motor 280 is energized to advance the puller, thus advancing the completed section of the truss and all of the wires from the wire storage loops. It will be understood that although many of the operations are described as being performed in sequence, various motions may occur together, in either partially or fully overlapping chronology so as to increase the rate of operation.

After advance of the work by the truss puller, the bending, welding and retraction steps are repeated, the entire cycle of bending, welding, retraction and work advance requiring approximately one second in a presently operating embodiment.

After a preselected length of truss has been completed, cut-off motor 296 is actuated to sever a completed section of truss.

CONTROL

The particular mechanism for controlling the several drive motors may be varied according to choice or design, provided that the various operations occur in the particular chronological sequence or equivalent sequences as described above. In fact, if deemed necessary or desirable, the several operations can be individually commanded manually. However, mechanisms for controlling operation of a number of valve operated hydraulic or air motors are readily available and widely known, and such a mechanism is preferred in order to achieve fully automatic and continuous operation. For example, a controller of the type made by Western Pacific, Model No. 10-E-IS, may be employed to actuate each of the several air cylinders in the desired sequence. Such a control system is schematically illustrated in FIG. 15, which shows a motor 400 continuously running at fixed speed and driving a cam shaft 402 on which are mounted a plurality of individually adjustable cams 404*a*, 404*b* through 404*n*. Each cam is arranged to operate an individual one of a plurality of microswitches 406*a* through 406*n*, which are in circuit with an electric power supply 408, a power switch 410 and a plurality of solenoid operated motor control valves 412*a* through 412*n*. Each valve has a plurality of input/output lins including a line 414*a* connected to an individual one of the air motor cylinders, a line 416*a* connected to ambient atmosphere for exhaust and a line 418*a* connected via a common pressure line 420 to a source of air pressure 422. Each single-acting motor will have one such valve connected thereto, whereas each double-acting motor may have two such valves, or different valving arrangements may be employed as is well known.

MODIFICATIONS

As mentioned above, the bending operation requires blocking dies that merely hold a previously bent area of the strut wire while an intermediate area is transversely displaced and a rearward area is moved toward the blocking dies. It is important that the blocking dies be able to grasp the area of bend of a previously bent diagonally extending portion of the strut wire, even though it may not be precisely positioned in any pre-determined location. This ensures that each apex is formed by a sharp bend with no unbent longitudinally extending wire portions between the two inclined sides of a single bend. A presently preferred form of blocking dies is shown in FIG. 6. Alternatively, blocking dies may take the configuration illustrated in FIG. 16 where in the inner blocking die 150, its operation and its mounting are just the same as in the embodiment of FIG. 6. However, in the arrangement of FIG. 16, the outer blocking die is not a rotary die but is formed of a die block 430 having a downwardly projecting die pin 432. This outer blocking die pin 432 is driven in a horizontal plane transversely of the longitudinal extent of the wire processing path by an air motor 434. The die body is formed with a transversely extending slot 436 adapted to receive an upper end of the inner blocking die 150 to the extent that such upper end extends above the strut wire that is captured between the horizontal surface of the inner blocking die guide plate 160 and the lower horizontal surface 438 of the outer blocking die. In the arrangement of FIG. 16, the rack and pinion to rotate the outer blocking die of FIG. 6 are eliminated and the air motor directly drives the outer blocking die 430 back and forth along a line perpendicular to the longitudinal extent of the processing path.

The arrangement illustrated in FIG. 13 is presently preferred for individual closed loop driving of the respective wires into their respective storage loops. However, it will be readily appreciated that other independent drives may be employed. Thus, instead of using a single motor and plurality of clutches for driving the several wires, each pair of feed rollers may be directly operated by its own separate motor, independently controlled by an individual storage loop sensor and feed back switch. Alternatively, as shown in FIG. 17, a common shaft 450, driven continuously at a fixed speed by a single motor 451, may be employed with a plurality of rollers 452, 454, 456, one for each wire fixed thereto, and continuously rotated. Idler rollers 458, 460, 462 are mounted for reciprocation radially of the continuously rotating rollers 452, 454, 456, respectively. Such reciprocating rollers are mounted on ends of individual pivoted arms 464, 466, 468 that are driven by air motors 470, 472, 474. The air motors are controlled by the storage loop sensors and feed back switches 80, 82, 84 to press the individual wires against the continuously rotating rollers when feed of the wire is required and may be slightly radially displaced to allow the wire to slide relative to the continuously rotating roller when no wire feed is desired. Continuously driven rollers 452, 454, 456 may be formed by a single elongated roller.

Although the described apparatus produces a completed truss section of continuous length, it will be understood that the methods and apparatus described herein, with but minor modification, may be employed to manufacture solely a continuous sinously bent wire, namely the strut wire 10, for use in other types of trusses or in different applications wherever such a sinuous wire would be of benefit. The described methods and apparatus enable extremely simple, economical and rapid manufacture of a sinuous wire of great uniformity and precision.

There have been described methods and apparatus for manufacture of a wire truss and a sinuously bent strut embodying unique methods and equipment that provide a truss of great strength, dimensional precision and uniformity of configuration, produced simply, rapidly and with maximum economy.

The foregoing detailed description is to be clearly understood and is given by way of illustration and example only; the spirit and scope of this invention being limited solely by the appended claims.

What is claimed is:

1. The method of making a wire truss comprising clamping a first wire at a rearward area thereof that is rearwardly spaced from a previously bent forward area thereof, moving blocking dies into engagement with said previously bent area to resist forward and transverse motion of said wire at said previously bent area, transversely displacing an intermediate area of said wire between said forward and rear areas, said step of transversely displacing an intermediate area comprising pivoting a displacement die guide toward said blocking dies, engaging said intermediate area with a displacement die, and driving said displacement die along said guide, moving said rearward and forward areas toward each other as said intermediate area is displaced, whereby said wire is bent at each of said areas, withdrawing said blocking dies, advancing said wire, clamping said wire at a second rearward area displaced from said first mentioned rearward area, moving blocking dies into engagement with said first mentioned rearward area, after it has been bent, to resist forward and transverse motion thereof, transversely displacing a second intermediate area of said wire between said first mentioned and second rearward areas, moving one of said rearward areas toward the other as said second intermediate area is displaced, whereby said wire is bent at said second intermediate area, at said second rearward area, and is further bent at said first mentioned rearward area, assembling first and second lateral wires to said first wire in contact therewith at points near said bent areas, and attaching said wires to each other at points of contact therebetween.

2. The method of claim 1 wherein said forward area is partially bent as said first mentioned intermediate area is transversely displaced, and wherein said step of moving blocking dies involves rotating an outer blocking die around said partially bent forward area before said second intermediate area is transversely displaced.

3. The method of claim 1 wherein said bends are all made in a single plane and said previously bent area includes a diagonally extending portion, and wherein said step of moving blocking dies comprises contacting said diagonally extending portion by and between a retractable inner blocking die and a shiftable outer blocking die.

4. The method of claim 1 wherein said bends are all formed in a common plane and wherein one of said blocking dies is movable along a line at an angle to said plane.

5. The method of claim 4 wherein a second one of said blocking dies is rotated about an axis at an angle to said plane.

6. The method of claim 1 wherein said step of assembling comprises positioning said lateral wires on opposite sides of and displaced from bent portions of said first wire, advancing said lateral wires together with said first wire, and moving said lateral wires toward said bent portions as said wires are advanced.

7. The method of claim 6 including the step of supporting said bent portios of said first wire in a first plane, guiding said lateral wires in a second plane displaced from said first plane as said lateral wires are moved toward said bent portions.

8. The method of claim 7 wherein bent portions of said first wire lie in a common plane of bend and form a sinuous curve having laterally disposed apices, and wherein said step of moving the lateral wires comprises guiding them into contact with said first wire near said apices and on one side of said plane of bend.

9. The method of making a wire truss comprising clamping a first wire at a rearward area thereof that is rearwardly spaced from a previously bent forward area thereof, moving blocking dies into engagement with said previously bent area to resist forward and transverse motion of said wire at said previously bent area, transversely displacing an intermediate area of said wire between said forward and rear areas, moving said rearward and forward areas toward each other as said intermediate area is displaced, whereby said wire is bent at each of said areas, withdrawing said blocking dies, advancing said wire, clamping said wire at a second rearward area displaced from said first mentioned rearward area, moving blocking dies into engagement with said first mentioned rearward area, after it has been bent, to resist forward and transverse motion thereof, transversely displacing a second intermediate area of said wire between said first mentioned and second rearward areas, moving one of said rearward areas toward the other as said second intermediate area is displaced, whereby said wire is bent at said second intermediate area, at said second rearward area, and is further bent at said first mentioned rearward area, assembling first and second lateral wires to said first wire in contact therewith at points near said bent areas, and attaching said wires to each other at points of contact therebetween, said step of attaching comprising holding said lateral wires in mutually spaced positions, holding bent portions of said first wire in predetermined positions relative to said lateral wires by exerting oppositely directed transverse pressures in the plane of and on opposite sides of said bent portions to transversely position said first wire, and welding said lateral wires to said first wire.

10. The method of claim 9 wherein said step of holding said lateral wires comprises positioning said lateral wires in mutually spaced longitudinal grooves.

11. The method of claim 1 wherein said steps of moving blocking dies comprises extending a retractable inner blocking die in a direction transverse to the plane of bend of said first wire and into contact with one side of a bend apex of said first wire at a previously formed bend, and moving a shiftable outer blocking die into contact with the other side of the bend apex of said previously formed bend.

12. The method of claim 1 including the steps of supplying a length of said first wire from a wire supply, feeding wire from said supply to a station at which said first wire is clamped, displaced and bent, and storing a variable length of wire between said wire supply and said station.

13. The method of claim 12 wherein said storing comprises driving said first wire along a curved path of variable length and curvature, and controlling the driving of said first wire so as to control the length of wire in said path.

14. The method of claim 13 wherein said step of controlling comprises sensing position of wire in a section of said path and varying said driving in accordance with sensed wire position.

15. The method of claim 1 wherein said clamping and transversely displacing are carried out at a bending station, and including storing a length of said first wire in a variable length storage loop, and feeding wire from said storage loop to said bending station.

16. The method of claim 15 including feeding wire from a wire supply to said storage loop, sensing the amount of wire in said storage loop, and controlling the feeding of wire from said wire supply to said storage loop in accordance with the amount of wire in said loop.

17. The method of claim 15 including storing lengths of said first and second lateral wires in second and third storage loops, feeding wire from said second and third storage loops for assembly to said first wire at points near bent areas of said first wire, sensing the amount of wire in each of said storage loops individually, and varying the amount of wire in said storage loops in a sense to minimize changes in such amounts.

18. The method of claim 17 wherein said step of varying the amount of wire comprises feeding said first wire and said first and second lateral wires from a plurality of wire supply rolls to and between pairs of rollers, and individually driving said pairs in accordance with the amount of wire in respective ones of said storage loops.

19. The method of claim 18 wherein said step of feeding wire from said wire supply rolls to said roller pairs comprises passing each of said wires around a drum between said wire supply rolls and said roller pairs, and rotating said drum, whereby said drum will pull one or another of said wires from said supply rolls in accordance with tension applied to individual wires by the driving of individual wires from said roller pairs.

20. A machine for manufacture of wire trusses of the type comprising a continuous and sinuous strut member connected to a pair of lateral wire runners, said machine comprising first clamp means for clamping a strut wire at a rearward area spaced rearwardly of a previously bent forward area thereof, first and second movably mounted blocking dies, means for moving said blocking dies into engagement with said previously bent area to resist forward and transverse motion of said previously bent area, means for transversely displacing an intermediate area of said wire between said forward and rear areas, said means for transversely displacing an intermediate area of said strut wire comprising a displacement die guide mounted for pivotal motion, a displacement die mounted to said guide for slidable motion along said guide and means for driving said displacement die along said guide, means for moving said blocking dies and said clamp means toward each other as said intermediate area is transversely displaced, whereby said wire is bent at each of said areas, means for longitudinally advancing said strut wire after it has been bent, means for assembling first and second lateral wires to said strut wire, and means for fixedly securing said lateral wires to said strut wire.

21. The machine of claim 20 wherein said means for assembling said lateral wires to said strut wire comprises means for driving all of said wires in a generally longitudinal direction thereof, means for guiding said strut wire along a longitudinal path after it has been bent, and first and second lateral guide means for respectively guiding said lateral wires from positions spaced from said strut wire into positions wherein said lateral wires are adjacent said strut wire at oppositely disposed bent portions thereof.

22. The machine of claim 20 wherein said blocking dies include an outer blocking die movably mounted between a first position in which it clears the path of said strut wire as it advances longitudinally after it has been bent and a second position in which the outer blocking die abuts a diagonally extending portion of said strut wire at a previous bend thereof to oppose longitudinal motion of the strut wire.

23. The machine of claim 20 wherein said blocking dies include an inner blocking die movable between a first position displaced from the plane of bend of said strut wire and a second position in which it projects across the plane of bend of said strut wire, whereby said strut wire is bent around said inner blocking die as said intermediate area is transversely displaced, and an outer blocking die mounted for rotation about said inner blocking die, said means for moving said blocking dies comprising means for rotating said outer blocking die, and means for axially shifting said inner blocking die.

24. The machine of claim 20 including cam means for pivotally shifting said displacement die and guide as the displacement die is moved in one direction transverse to said strut wire.

25. A machine for manufacture of wire trusses of the type comprising a continuous and sinuous strut member connected to a pair of lateral wire runners, said machine comprising first clamp means for clamping a strut wire at a rearward area spaced rearwardly of a previously bent forward area thereof, first and second movably mounted blocking dies, means for moving said blocking dies into engagement with said previously bent area to resist forward and transverse motion of said previously bent area, means for transversely displacing an intermediate area of said wire between said forward and rear areas, means for moving said blocking dies and said clamp means toward each other as said intermediate area is transversely displaced, whereby said wire is bent at each of said areas, means for longitudinally advancing said strut wire after it has been bent, means for assembling first and second lateral wire runners to said strut wire, means for fixedly securing said lateral wire runners to said strut wire, and first and second laterally spaced holding guide means for positioning said first and second lateral runners respectively, first and second holding finger means for applying mutually opposed pressures to and in the plane of said strut wire to position said strut wire relative to said lateral runners.

26. The machine of claim 25 wherein said holding finger means each comprises a finger element having a recessed end adapted to receive and press against an apex of a bend of the sinuous strut member, means for mounting said finger elements for motion between a position in which said recessed ends press against strut apices on opposite sides of said strut member and a second position in which the finger elements are withdrawn from said apices, and means for shifting said finger elements between said positions thereof.

27. The machine of claim 20 including a source of wire, means for feeding wire from said source to said first clamp means, and means for storing a variable length of wire between said source and said clamp means.

28. The machine of claim 27 wherein said means for storing comprises means for feeding wire along a curved path of variable length and curvature, and means for controlling said feeding means so as to control the amount of wire in said path.

29. The machine of claim 28 wherein said means for controlling comprises means for sensing the position of wire in a section of said path and means responsive to said sensing means for controlling operation of said feeding means.

30. The machine of claim 20 including means for storing a length of said strut wire in a variable length storage loop, and means for feeding wire from said storage loop to said first clamp means.

31. The machine of claim 30 wherein said means for feeding comprises a source of wire, means for driving wire from said source to said storage loop, means for sensing the amount of wire in said storage loop, and means for controlling said means for driving wire from said source to said storage loop in accordance with the amount of wire sensed in said loop.

32. The machine of claim 30 including means for storing lengths of said first and second lateral runner wires in second and third storage loops, means for feeding wire from said second and third storage loops for assembly to said strut wire at points near bent areas thereof, means for sensing the amount of wire in each of said storage loops individually, and means responsive to said sensing means for individually varying the amount of wire in respective ones of said storage loops in a sense to minimize changes in such amounts.

33. The machine of claim 32 wherein said means for varying the amount of wire comprises a plurality of wire sources, a plurality of roller pairs, said strut wire and said first and second lateral runner wires passing from respective ones of said wire sources to said roller pairs, and means for individually driving said pairs in response to said sensing means to separately and individually drive said wires.

34. The machine of claim 33 including a drum interposed between said wire sources and said roller pairs, wire between each said wire source and said roller pairs passing around said drum, and means for rotating said drum, whereby said drum will pull one or another of said wires from said wire sources in accordance with tension applied to individual wires by said roller pairs.

35. The machine of claim 32 wherein said means for varying the amount of wire comprises a plurality of wire sources, roller means, said strut wire and said runner wires passing from respective ones of said wire sources across said roller means, means for rotating said roller means, and means for individually pressing said wires against said roller means to separately and individually vary the force of engagement of said wires with said roller means.

36. A machine for making wire trusses comprising a machine bed, a rear clamp slide mounted for longitudinal motion along said bed, a rear clamp die fixed to said slide, a movable rear clamp part movably mounted to said slide for motion toward and away from said rear clamp die, means for driving said slide back and forth along said machine bed, means for driving said rear clamp part toward and away from said rear clamp die, whereby a strut wire may be clamped therebetween or released therefrom, a blocking bend pin die slidably mounted to said machine bed for vertical motion, means for driving said blocking bend pin die upwardly and downwardly, a rotary blocking die shaft mounted to and above said machine bed for rotation about an axis coaxial with said bend pin die, a rotary blocking die fixed to a lower end of said shaft and including a die surface positioned to move around the periphery of said blocking bend pin die in proximity thereto, means for rotating said rotary blocking die shaft, a transverse die guide pivoted to said machine bed for motion about a vertical axis laterally displaced from said bed, said guide extending toward said bed, a transverse displacement die slidably mounted for motion on said guide in a direction transverse to said machine bed, means for driving said displacement die along said guide, whereby a strut wire may be sinuously bent by said dies, means for precisely positioning said displacement die about said vertical axis in one transverse position of said displacement die, means on said bed positioned forwardly of said blocking dies for guiding a strut wire bent by said dies and for guiding a pair of lateral runner wires toward oppositely disposed portions of said sinuously bent strut wire, and means for welding said lateral wires to said sinuously bent strut wire.

37. The machine of claim 36 wherein said means for guiding comprises first and second laterally spaced guide blocks having first and second laterally spaced and mutually facing guide channels extending longitudinally of said machine bed, each said guide block having a longitudinally extending groove formed in a face of the guide channel thereof, each said groove being inclined laterally inwardly toward a forward end of its guide block, whereby said sinuously bent strut wire may be guided longitudinally of said machine bed in said guide channels and first and second lateral runner wires may be guided in laterally inwardly directed paths toward contact with said sinuously bent strut wire by said inwardly inclined grooves.

38. The machine of claim 36 wherein said means for welding comprises first and second laterally spaced lateral wire grooves for receiving and positioning lateral wires to be welded to said strut wire, first and second weld finger carrier blocks fixed to said machine bed at opposite sides of said strut wire laterally outwardly of said wire guide grooves, each said finger carrier block having a weld finger slidably mounted thereon for transverse motion toward and away from said lateral wire guide grooves in a plane adjacent to and displaced from lateral wire guide grooves, each said weld finger having a recessed inner end adapted to receive and press against a bent portion of a sinuously bent strut wire interposed between said weld fingers, means for shifting said fingers inwardly and outwardly of said machine bed, and first and second welding electrodes mounted for vertical reciprocation toward and away from said weld finger recesses respectively.

39. The machine of claim 36 including first and second lateral wire supply rolls, a strut wire supply roll, a drum, means for rotating the drum, wire from each said supply roll being passed around said drum, a plurality of pairs of rollers, clutch means for selectively rotating a roller of each said pair of rollers, wire from said drum being passed between rollers of said pairs, wire from said roller pairs being passed to said dies and guiding means along first, second and third paths of variable length and variable curvature, sensing means for individually sensing position of wire in each of said first, second and third paths, and means responsive to said sensing means for individually controlling said clutch means to decrease changes in said paths respectively.

40. A machine for sinuously bending wire comprising a machine bed, a rear clamp mounted for longitudinal motion along said bed, means for driving said clamp back and forth along said machine bed, means for actuating said clamp whereby a wire may be clamped thereby or released therefrom, a blocking bend pin die slidably mounted to said machine bed for transverse motion, means for driving said blocking bend pin die, a rotary blocking die shaft mounted to and spaced from said machine bed for rotation about an axis coaxial with said bend pin die, a rotary blocking die fixed to an end of said shaft and positioned to move around the periphery of said blocking bend pin die in proximity thereto, means for rotating said rotary blocking die shaft, a transverse displacement die mounted on said bed for motion in a direction transverse to said machine bed, and means for driving said displacement die, whereby a wire may be sinuously bent by said dies.

41. A machine for manufacture of a continuous and sinuous wire member, said machine comprising clamp means for clamping a wire at a rearward area spaced rearwardly of a previously bent forward area thereof, first and second movably mounted blocking dies, means for moving said blocking dies into engagement with said previously bent area to resist forward and transverse motion of said previously bent area, means for transversely displacing an intermediate area of said wire between said forward and rear areas, said means for transversely displacing an intermediate area of said wire comprising a pivotally mounted displacement die guide, a displacement die movably mounted on said displacement die guide, and means for driving said displacement die relative to said displacement die guide, means for moving said blocking dies and said clamp means toward each other as said intermediate area is transversely displaced, whereby said wire is bent at each of said areas, means for withdrawing said blocking dies, and means for longitudinally advancing said wire, after it has been bent.

42. The machine of claim 41 wherein said blocking dies include an outer blocking die movably mounted between a first position in which it clears the path of said wire as the wire advances longitudinally after it has been bent and a second position in which it lies in abutment with said strut wire to oppose longitudinal motion of the strut wire.

43. The machine of claim 41 wherein strut wire is bent to provide a plurality of diagonal portions extending between bend apices, and wherein said means for moving said dies and clamp means toward each other comprise means for moving said clamp means forwardly, and means including said outer blocking die for contacting a diagonal portion of said strut wire adjacent an apex thereof so as to resist forward motion of said forward area of said strut wire as said clamp means moves forwardly.

44. The machine of claim 42 wherein said blocking dies include an inner blocking die movable between a first position displaced from the plane of bend of said wire and a second position in which it projects across the plane of bend of said wire, whereby said wire is bent around said inner blocking die as said intermediate area is transversely displaced, and an outer blocking die, said means for moving said blocking dies comprising means for rotating said outer blocking die, and means for axially shifting said inner blocking die.

45. A machine for manufacture of a continuous and sinuous wire member, said machine comprising clamp means for clamping a wire at a rearward area spaced rearwardly of a previously bent forward area thereof, first and second movably mounted blocking dies, means for moving said blocking dies into engagement with said previously bent area to resist forward and transverse motion of said previously bent area, means for transversely displacing an intermediate area of said wire between said forward and rear areas, means for moving said blocking dies and said clamp means toward each other as said intermediate area is transversely displaced, whereby said wire is bent at each of said areas, means for withdrawing said blocking dies, means for longitudinally advancing said wire, after it has been bent, said means for transversely displacing an intermediate area of said wire comprising a displacement die guide mounted for pivotal motion, a displacement die mounted to said guide for slidable motion along said guide, means for driving said displacement die along said guide, and cam means for pivotally shifting said displacement die and guide as the displacement die is moved in one direction transverse to said wire.

46. A machine for manufacture of wire trusses of the type comprising a continuous and sinuous strut member connected to a pair of lateral wire runners, said machine comprising first clamp means for clamping a strut wire at a rearward area spaced rearwardly of a previously bent forward area thereof, second clamp means, said second clamp means comprising a blocking bend die slidably mounted to said machine bed for transverse motion, means for driving said blocking bend die, a rotary blocking die shaft mounted to said machine bed for rotation, a rotary blocking die mounted on said shaft to move around said blocking bend die in proximity thereto, and motor means for rotating said blocking die shaft, means for moving said second clamp means into engagement with said previously bent area to resist forward and transverse motion of said previously bent area, means for transversely displacing an intermediate area of said wire between said forward and rear areas, means for moving said first and second clamp means toward each other as said intermediate area is transversely displaced, whereby said wire is bent at each of said areas, means for longitudinally advancing said strut wire after it has been bent, means for assembling first and second lateal wires to said strut wire, and means for fixedly securing said lateral wires to said strut wire.

47. The machine of claim 46 wherein said second clamp means includes guide surfaces for guiding wire passing said clamp means.

48. The machine of claim 46 wherein said second clamp means includes means for capturing a diagonal portion of said bent area to accommodate variations in position of said previously bent area.

* * * * *